United States Patent [19]

Kölbel

[11] 4,290,600

[45] Sep. 22, 1981

[54] PUSH-PULL PHYSICAL EXERCISING DEVICE

[75] Inventor: Gert F. Kölbel, Hanover, Fed. Rep. of Germany

[73] Assignee: Compret N.V., Amsterdam, Netherlands

[21] Appl. No.: 879,581

[22] Filed: Feb. 21, 1978

[30] Foreign Application Priority Data

Sep. 9, 1977 [GB] United Kingdom ..... 37820/77

[51] Int. Cl.[3] ..... A63B 21/02

[52] U.S. Cl. ..... 272/137; 272/130; 272/143; 272/141; 272/DIG. 5

[58] Field of Search ..... 272/137, 141, 143, 135, 272/DIG. 4, DIG. 5, 130, 68; 267/170, 174, 179

[56] References Cited

U.S. PATENT DOCUMENTS

| | | | |
|---|---|---|---|
| 1,023,756 | 4/1912 | Pons | 272/141 |
| 3,268,225 | 8/1966 | Kolbel | 272/137 |
| 3,536,326 | 10/1970 | Yatrides | 272/137 |
| 3,633,908 | 1/1972 | Krauth | 272/141 X |
| 3,746,339 | 7/1973 | Cox | 272/137 |

FOREIGN PATENT DOCUMENTS

| | | | |
|---|---|---|---|
| 2051786 | 5/1972 | Fed. Rep. of Germany | 272/141 |

*Primary Examiner*—Richard C. Pinkham
*Assistant Examiner*—William R. Browne
*Attorney, Agent, or Firm*—Blum, Kaplan, Friedman, Silberman & Beran

[57] ABSTRACT

A physical exerciser of the type having a spring enclosed by a telescopic tubular system so that contraction of the system is resisted by the spring. Flexible connecting elements connect the ends of the system on opposite sides so that pushing exercises can be performed by pushing handles at the ends together and pulling exercises by pulling the flexible elements apart. According to the preferred form of the invention each flexible connecting element is continuous in the form of two runs guided round one or two rolling members mounted in handles at the ends of the system. Either one or both runs can be pulled giving variation in the force and movement distance. According to another feature a greater contraction distance of the telescopic system is achieved by an arrangement having a central tube beyond the ends of which the ends of the spring extend and further end tubes accommodating the ends of the spring and connected to the handles so that the majority of the interior of the handles also accommodates part of the telescopic movement.

24 Claims, 8 Drawing Figures

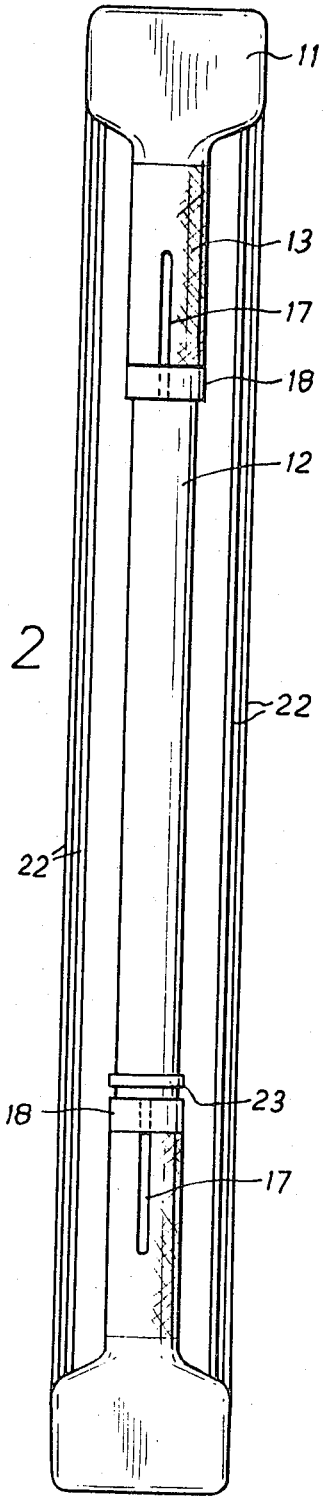
FIG. 2
FIG. 3
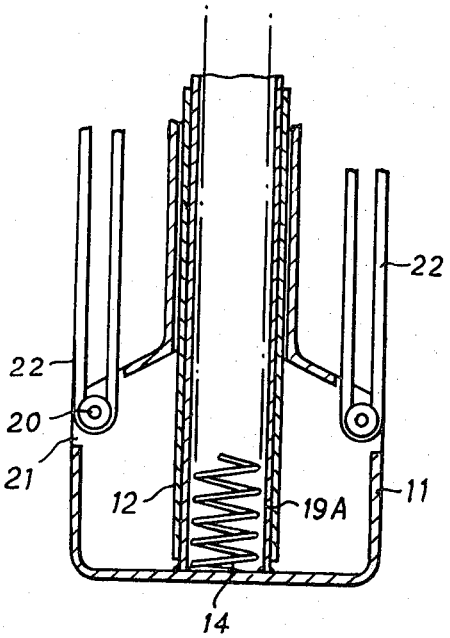

PUSH-PULL PHYSICAL EXERCISING DEVICE

BACKGROUND OF THE INVENTION

In my U.S. Pat. No. 3,268,225 there is described a spring type exerciser involving a telescopic arrangement including a spring so that as the telescopic system is collapsed the spring is placed under compression; also an endless rope is connected to the handles at the ends of the telescopic system so that as two runs of the rope are pulled apart the spring is again placed under compression. In use certain exercises comprise squeezing the spring by applying force to the handles at each end and certain exercises comprise pulling the two runs of rope apart and again placing the spring under compression. In this way the exercises bring into play different muscles involving forces of both compression and tension while at the same time the work by the person using the exerciser always acts on the spring to place it under compression.

An object of the present invention is to provide a physical exerciser of the type described in my U.S. Pat. No. 3,268,225 which is simplified in construction and allows the user the possibility of carrying out a wider range of exercises.

It is another object of the invention to provide an exerciser which gives a greater amount of contraction for the same initial length of telescopic system.

It is a still further object of the invention to produce an exerciser which allows the user to vary the movement distance during an exercise and to vary the strength required to move the tension elements during exercise.

SUMMARY OF THE INVENTION

Accordingly the present invention provides a physical exerciser comprising an elongated telescopic system having ends, the system being contractible longitudinally by the application of manual pressure, resilient biassing means arranged to resist contraction of the system, and a pair of flexiable tension elements connecting the ends of the system on opposite sides thereof. According to one preferred feature, for each tension element a guide member is carried by one of said ends, each tension element extending in two runs between said ends and between the runs passing round an associated guide member, such that pulling exercises may be performed by pulling one or both runs of each tension element. This provides an automatic and easily selected variation of the distance through which the tension elements move for contraction of the telescopic system and variation of the strength required to contract the system. Preferably each tension member is endless and passes round two sheaves or rollers mounted in handles at the ends of the system.

According to another feature, the telescopic system comprises a central tube beyond the ends of which spring means forming the biassing means extends, and a pair of end tubes, each having a handle secured at its outer end, are slidably and telescopically mounted at opposite ends of the central tube with the spring means extending the full length of the system within the handles and the handles accommodating the ends of the central tube at maximum compression. This allows the system to be contracted to only just over half its initial length, since the only part which does not contribute to the telescopic movement is a small distance at the closed end of the handles.

According to a further feature the inner end of each end tube and the outer ends of the central tube carry inter-engageable flange means to hold the end tubes against dis-engagement from the central tube, and the inner end of each end tube is slit or bifurcated to allow it to open slightly for initial assembly. A ring member is located around the slit ends to hold them against such opening in the normal assembled position.

According to a still further feature the outer surface of each end tube is pre-formed with a grip surface so that the tubes can be gripped for pushing exercises with the hands parallel to the telescopic system, thus exercising still further muscles.

DETAILED DESCRIPTION OF EMBODIMENTS OF THE INVENTION

Figure 1:
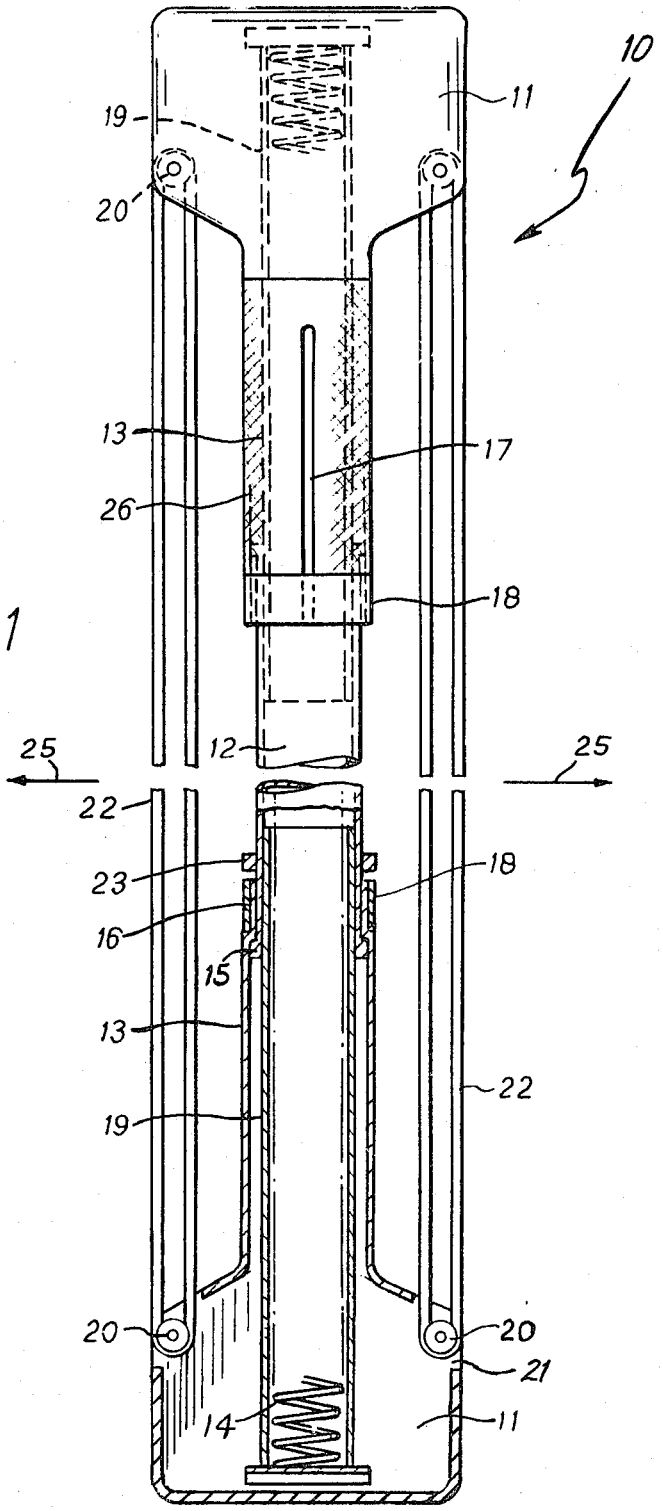
Figure 4:
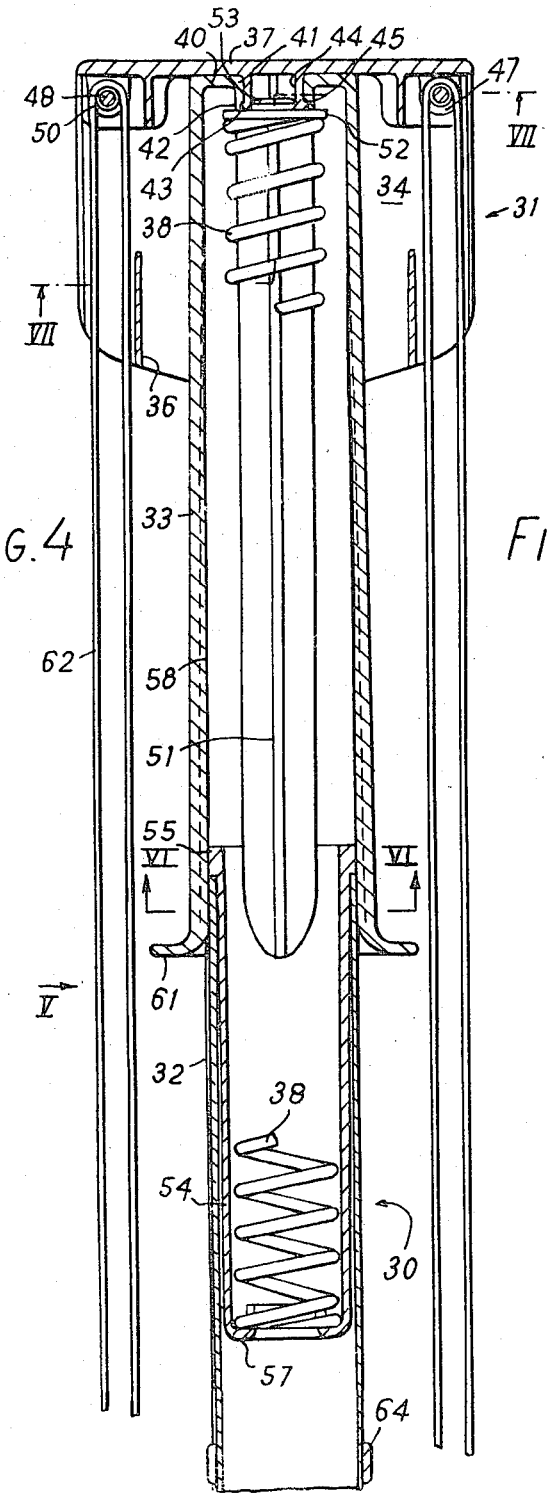
Figure 5:
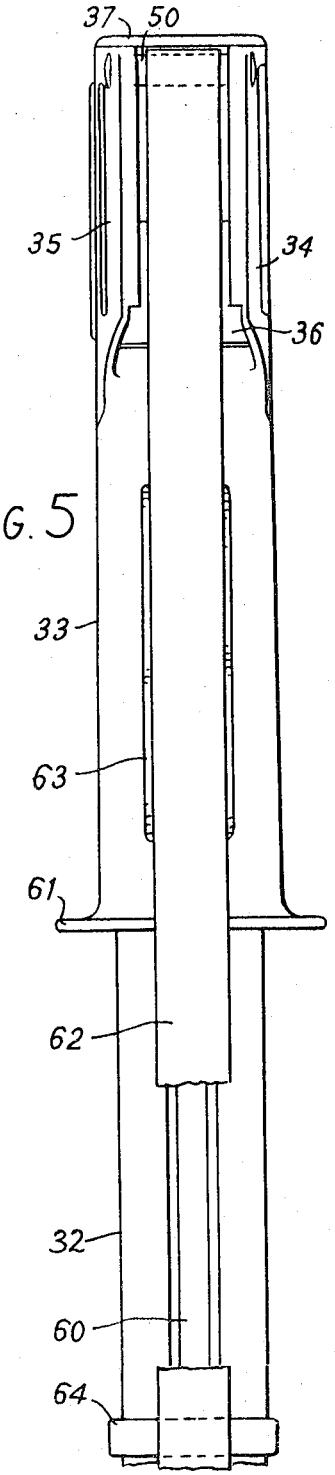
Figure 6:
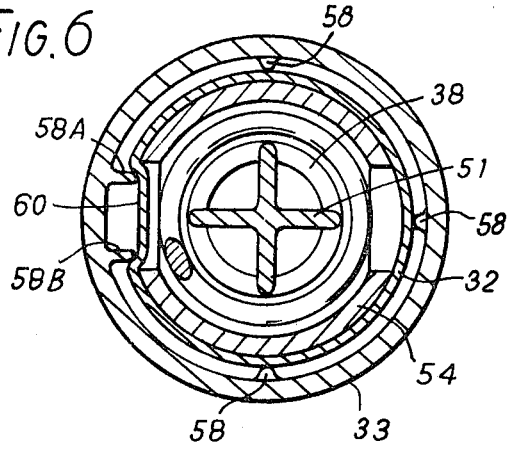
Figure 7:
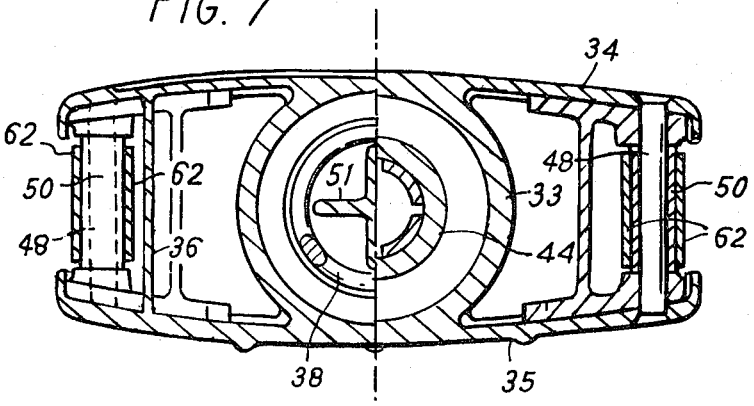
Figure 8:
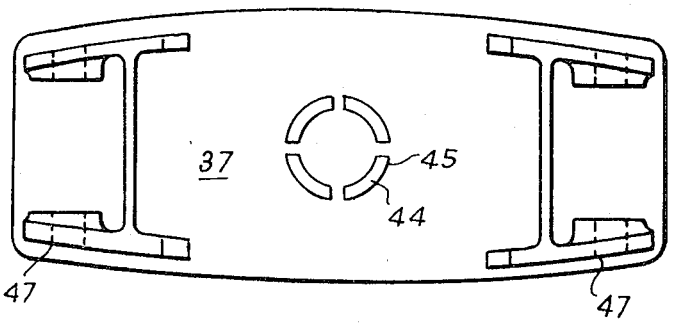

The invention will be more readily understood from the following description, giving by way of example only, of exercising devices in accordance therewith, reference being made to the accompanying drawings of which:

FIG. 1 is a diagrammatic, partly broken away, view of an exerciser with one end partly in section and with the exerciser in its fully extended condition, FIG. 2 is a front view of the exerciser in its fully extended condition, and, FIG. 3 is a view of part of the exerciser of FIGS. 1 and 2 in section in its fully contracted condition, showing one minor modification, FIG. 4 is an axial section through one end of a modified form of exerciser in its fully extended condition, FIG. 5 is a side view of the exerciser, taken in the direction of arrow V of FIG. 4, FIG. 6 is the section on the line VI—VI of FIG. 4, FIG. 7 is a section on the line VII—VII of FIG. 4 with the end plate of the exerciser removed, and, FIG. 8 is an end view of the end plate of a handle of the exerciser of FIGS. 4 to 7.

Referring to FIGS. 1 to 3, a physical exerciser comprises an elongated telescopic system 10 having hollow handles 11 at its ends, the system being contractible longitudinally by the application of manual pressure. In known manner the handles may be formed with finger indentations to aid gripping. The telescopic system comprises a main central tube 12 and two end tubes or shafts 13 integral at their outer ends with the handles 11. A resilient biassing means in the form of a helical spring 14 extends within the central tube with both its ends extending beyond the central tube into the tubes 13 and abutting against the ends of the hollow interiors of the handles. The ends of the central tube 12 are outwardly flanged at 15 and the inner ends of the end tubes 13 are inwardly flanged at 16 so that interengagement of flanges 15 and 16 prevents the end tubes from disengaging from the central tube. The inner portions of the tubes 13 are of bifurcated form as a result of two slits 17 (only one of which is seen in FIG. 1) extending for part of their lengths. This allows the end tubes 13 to be expanded slightly so that the flange 16 can ride over the flange 15 for initial assembly. A simple end ring 18 is then pushed over each end to retain it against such expansion in the assembled condition. Extra guide tubes 19 integral with the handles and coaxially within the tubes 13 fit inside the tube 12 and provide additional strength and guidance. A modified form of these is shown at 19A in FIG. 3.

The handles 11 extend outwardly of the tubes 13 in a direction normal to the longitudinal axis of the telescopic system and at each side carry a rolling member in the form of a sheave 20, mounted across a groove 21 opening to the side of the handle. Two tension elements 22 located on opposite sides of the telescopic system connect the ends of the system. Each tension element takes the form of a substantially inextensible endless cord which extends in two runs between the handles and passes around a pair of sheaves. These elements can be, for example, of plastic coated wire or any form of rope, they can be flat or of round cross section and they may be initially limp or under slight tension in the rest position of the exerciser. Each tension element could extend round a single sheave or other guide element and have both its ends fastened to one handle so that it is effectively endless.

The tension elements can be gripped approximately at their mid points and pulled apart in the direction of arrows 25 this causing the handles to move towards each other and compress the spring. The movement distance which is available for an exercise is determined by the distance which the telescopic system can contract in conjunction with the length of the tension elements between the handles. However, by the use of a double run of cord this distance and the force required can be varied by the person doing exercises. If both runs of each tension element are gripped, then maximum force will be required for a relatively small movement. If only the outermost runs of the tension elements are gripped the movement distance increases, since when pulling apart in the direction of the arrows a considerable portion of the inner runs, that is those nearest to the tubes, runs around the sheaves so that the outer runs are extended. By this pattern of movement a block and tackle effect is obtained which reduces the force to be applied for compressing the spring while at the same time the movement distance is increased. This is of greater importance for many exercises than a short distance with a high tension force. A stepped change in tensile force can be obtained by first gripping both outer runs only, then both runs of one element and the outer run of the other, then both runs of both elements.

In addition to large movement distances being obtainable more exercises can be carried out in tension training. For example, between the feet and the upper body exercises can be carried out which are not possible on exercisers having a smaller movement distance. For example, one can wrap one strand of cord round the nape of the neck while the other strand is around the feet. Furthermore, compression and tension exercises are possible simultaneously, for example by pulling the apparatus between one foot and the nape of the neck in a sitting position with simultaneous pressure support by both hands. The number of such combination exercises is more than double that possible with the exerciser according to U.S. Pat. No. 3,268,225.

A ring 23 slides on the exterior of the tube 12 pushed by the end of a tube 13 and indicates the degree of compression on a scale marked on the exterior of the tube 12.

A further feature of the invention is the formation on the outer surfaces of the tubes 13 of a grip surface as seen at 26. This allows an important compression exercise with the hands gripping parallel to the telescopic system. The serrated exterior of the tubes extends for example for a 17 cm length of each tube, and for the first time renders possible gripping with the hands in the position parallel to the exerciser. This allows additional classes of muscles, hitherto not loaded, to be exercised.

The design of the telescopic system allows easy assembly by merely slipping the rings 18 over the central tube 12, pushing the end tubes 13 onto the central tube and pushing the rings 18 back over the ends of the end tubes to assemble the whole telescopic system. In addition the design of the handles allow almost their whole lengths to contribute to the telescopic movement so that the movement obtainable with compression exercises is 50% greater than with the exerciser of U.S. Pat. No. 3,268,225 for the same initial rest length. This is best seen in FIG. 3 where the central tube 12 nearly abuts against the interior of the end of the handle 11.

The exerciser of FIGS. 4 to 8 comprises a telescopic system 30 having hollow handles 31 at its ends. The telescopic system comprises a main central tube 32 and two end tubes 33 telescopically slidable on the central tube. Each end tube 33 is integral with the main part of its associated handle 31 formed by two outer side walls 34, 35 and connecting ribs 36, and end of each handle is closed by a separately fabricated end plate 37. The resilient biassing means in this embodiment is formed by two springs 38. It will be appreciated that although only one end of the exerciser is shown the other end is similar, so that only one of the springs 38 and one tube 33 and one handle 31 are shown and need to be described.

The tube 33 has its outer end, that is the end remote from the central tube 32, turned in to form a partially closed end 40 and then turned in again to provide an inwardly projecting annulus 41, the inner end 42 of which is counterbored to provide an annular shoulder 43. The end plate 37 has an inwardly projecting annulus 44 with an outwardly turned lip 45 so that is a push fit in the annulus 41 with the lip engaging over the shoulder 43 to retain it. The end plate 37 is also formed with bearing parts 47 which are a push fit between the side walls 34, 35 of the handles. These bearing parts carry pins 48 on which are rotatably mounted rollers 50.

A cruciform sectioned spring guide 51 has a disc 52 at its outer end from the outer side of which projects a boss 53 which is a push fit in the annulus 44 of the end plate with the disc bearing against the end surfaces of the annulge 41 and 44. The spring guide 51 thus extends coaxially within the tube 33 and had its inner end within the central tube 32 in the expanded condition of the exerciser. Within the end of the central tube 32 is located a spring retaining tubular member 54. This has an outer diameter adjacent its outer end which is a close fit within the tube 32 and has an outwardly turned flange 55 which abuts against the end of tube 32. The retaining member 54 tapers inwardly slightly towards its inner end which is turned over to provide a spring retaining end surface 57. The spring 38 fits over the spring guide 51 and within the retaining member 54 with its ends abutting the disc 52 and the retaining surface 57. The spring 38 has a slight outward taper towards its inner end.

As seen in FIG. 6 the inner surface of the end tube 33 is formed at four substantially equi-angularly spaced points with inwardly projecting rib members 58. At one side instead of a single rib 58 there are two spaced ribs 58A and 58B. The central tube 32 has a groove 60 formed in its exterior surface along its length in which groove are received the ribs 58A and 58B. This prevents relative rotation of the tube 33 and tube 32. The tube 33 tapers outwardly to increase its outer diameter towards the centre of the exerciser and the depth of the ribs 58 increases in this direction to retain the internal diameter of the notional cylinder defined by the ribs substantially constant. The inner end of tube 33 is outwardly flanged at 61.

In the contracted condition of the exerciser the ends of the spring guide 54 substantially abuts the bases of the tubes 33 so that the majority of the handles contribute to the telescopic movement as described in the embodiment of FIGS. 1 to 3.

As in the embodiment of FIGS. 1 to 3, two endless tension elements each having two runs connect the ends of the telescopic system on opposite sides thereof. In this embodiment each tension element 62 is in the form of a band of webbing material which passes round a pair of the rollers 50. The sides of the handles are open thus effectively defining grooves to accommodate the rollers and tension elements. As described with reference to the embodiment of FIGS. 1 to 3 either one or both of the runs of these tension elements can be gripped and pulled to provide the variation in movement distance and force for doing exercises. The tension elements are taut in the expanded condition of the exerciser as shown and prevent the end tubes 33 from coming off the central tube 32.

A grip surface, as seen at 63, is provided on the exterior surface of the tubes 33. A ring 64 similar to the ring 23 slides on the exterior of the tube 32.

It will be appreciated that the use of tension elements having a double run can be applied to telescopic systems, comprising only two tubes or more than three tubes.

It could be applied to a telescopic system which had two or more coupled sets of telescoping tubes or a system which was contractable and expandable without using telescoping tubes.

The spring biassing means may be replaced by other suitable resilient means such as elastic balls or a pneumatic assembly. The biassing means need not be within the telescopic system but could for example be a pair of stiffly flexible straight or bowed rods connecting the ends of the system and themselves capable of being grasped and pulled apart.

The flexible elements need not pass through the handles but could be secured to separate mounting or guide members carried by the telescoping system or could pass through or over the ends of the tubes.

What is claimed is:

1. A physical exerciser comprising: an elongate telescopic system having ends, said system being contractibile longitudinally by the application of pressure;

resilient biassing means arranged to resist said longitudinal contraction of said system;

at least two flexible tension means, each said tension means extending longitudinally in at least two runs;

a guide member associated with each of said tension means, said guide member being substantially adjacent one end of said system, each tension means passing around said associated guide member, said at least two runs extending unbroken from said guide member to a location substantially adjacent the other end of said system, said system contracting on pulling of said tension means away from said system, the amount of said contraction for a given pulling force being selectable by selecting the number of said runs of said tension means which are pulled.

2. An exerciser according to claim 1 and further comprising at least one guide member mounted at the other end of the system, and wherein said tension means are endless and run between said ends and around a pair of guide members.

3. A physical exerciser according to claim 2 in which said guide members are rolling members and further including handles at said ends of said telescopic system.

4. An exerciser according to claim 3 in which each handle has a separately fabricated end member and said end members carry the rolling members.

5. A physical exerciser according to claim 3, wherein said handles define grooves at their sides, said rolling members being mounted in said grooves.

6. A physical exerciser according to claim 1 in which said guide member is a sheave.

7. A physical exerciser according to claim 1 in which said guide member is a roller.

8. A physical exerciser according to claim 1 in which said telescopic system comprises a plurality of tubes slidable one in the other and containing coil spring means comprising said biassing means.

9. A physical exerciser according to claim 8 in which said telescopic system comprises a central tube beyond the ends of which said spring means extends and a pair of end tubes, each end tube having a handle secured at its outer end, said end tubes being slidably and telescopically mounted at opposite ends of said central tube with said spring means extending within said end tubes.

10. An exerciser according to claim 9 in which said handles are hollow and form part of said telescopic system such that said handles accommodate said central tube at maximum compression.

11. A physical exerciser according to claim 9 in which the inner end of each end tube and the outer ends of the central tube carry interengagable flange means to hold the end tubes against disengagement from the central tube, and the inner end of each end tube defines a slit which allows it to expand slightly for initial assembly, and including ring members around said slit ends to hold them against such expansion.

12. A physical exerciser according to claim 9 in which the outside surface of each said end tube has a grip surface formed thereon.

13. An exerciser according to claim 9 in which said spring means comprises two springs each having an inner end extending partially within said central tube and an outer end located adjacent to the end of an end tube, and including for each said spring a spring guide member carried by the handle and extending within the inner end of said spring and a spring retaining member carried by said central tube and retaining said spring inner end.

14. A physical exerciser according to claim 13 in which the inner end of each end tube and the outer ends of the central tube carry inter-engageable flange means to hold the end tubes against disengagement from the central tube, the inner end of each end tube is slit to allow it to expand slightly for initial assembly, and including ring members around said slit ends holding them against such expansion.

15. An exerciser according to claim 9 in which each said end tube has ribs on its internal surface, which ribs slide on said central tube.

16. An exerciser according to claim 15 in which the external surface of said central tube defines groove means which engages with at least one of said ribs to prevent relative rotation of the tubes.

17. A physical exerciser according to claim 1, 2, 16, 13, 16 or 5, wherein at least a pair of said at least two flexible tension means are separated one from the other and located on opposite sides of said system.

18. A physical exerciser comprising an elongate telescopic system containing resilient means arranged to resist contraction of said system, said system comprising a central tube and a pair of end tubes, each end tube having a handle secured at its outer end, said end tubes being slidably and telescopically mounted at opposite ends of said central tube, said handles being hollow beyond said end tubes and forming a continuous extension of said end tubes and said telescopic system, end portions of said central tube extending beyond said end tube outer ends at substantial contraction, said handles receiving therewithin said extended portions of said central tube at substantial contraction, and flexible tension means connecting said ends of said system such that pulling of the tension means away from the system tends to contract the system.

19. A physical exerciser according to claim 18, wherein said flexible tension means are located on opposite sides of said system.

20. A physical exerciser comprising: an elongate telescopic system having ends, said system being contractible longitudinally by the application of pressure;

resilient biassing means arranged to resist said longitudinal contraction of said system;

at least two flexible tension means, each said tension means extending longitudinally in at least two runs;

a guide member associated with each of said at least two tension means, said guide member being substantially adjacent one end of said system, each said at least two tension means passing around said associated guide member, said at least two runs extending unbroken from said guide member so as to be substantially adjacent the other end of said system, said system contracting on pulling of at least one said run away from said system, the amount of said contraction for a given pulling force being selectable by selecting the number of said runs of said at least two tension means which are pulled.

21. An exerciser according to claim 20 and further comprising a guide member associated with each of said at least two tension means and mounted at the other end of the system, said at least two tension means run between said ends and around at least a pair of said guide members.

22. An exerciser according to claim 21, wherein said tension means extend in at least two runs between said one end and said other end of said system.

23. An exerciser according to claim 21 or 22, wherein said at least two tension means are endless.

24. A physical exerciser according to claim 20, 21 or 22, wherein said telescopic system includes a central tube, a pair of end tubes mounted slidably and telescopically at opposite ends of said central tube, and handles at the outer ends of said end tubes, said handles being hollow beyond said end tubes in the direction of said sliding and forming a continuous extension of said end tubes and said telescopic system, end portions of said central tube extending beyond said outer ends of said end tubes when said system is substantially contracted, said handles receiving therewithin said extended end portions of said central tube when said system is substantially contracted.

* * * * *